US006013883A

United States Patent [19]

Janniere

[11] Patent Number: 6,013,883

[45] Date of Patent: Jan. 11, 2000

[54] MINIATURE ELECTRICAL SWITCH

[75] Inventor: Alan Janniere, Paris, France

[73] Assignee: ITT Manufacturing Enterprises, Wilmington, Del.

[21] Appl. No.: 09/362,606

[22] Filed: Jul. 28, 1999

[30] Foreign Application Priority Data

Jul. 31, 1998 [FR] France ..... 98 09851

[51] Int. Cl.[7] ..... H01H 9/26; H01H 19/00; H01H 1/26

[52] U.S. Cl. ..... 200/250; 200/6 R; 200/283

[58] Field of Search ..... 200/6 R–6 C, 200/16 R–16 D, 51 R, 51.09, 51.1, 51.11, 51.12, 51.13, 573, 574, 239, 241, 242, 245, 246, 250, 275, 282–284, 290, 292, 61.41, 61.42

[56] References Cited

U.S. PATENT DOCUMENTS

| | | | |
|---|---|---|---|
| 4,743,723 | 5/1988 | Seabeck | 200/250 |
| 5,007,851 | 4/1991 | Matsumoto | 439/188 |
| 5,262,601 | 11/1993 | Leopold | 200/6 R |
| 5,380,966 | 1/1995 | Liu | 200/283 |
| 5,811,744 | 9/1998 | Bartha | 200/5 A |

*Primary Examiner*—Michael Friedhofer
*Attorney, Agent, or Firm*—Thomas L. Peterson

[57] ABSTRACT

A miniature electrical switch that can be mounted on a circuit board, includes a dielectric housing (12) with a forwardly-opening cavity (26), a first contact (16) lying primarily within the cavity, and a second contact (14) lying outside the cavity and engaging the first contact except when the first contact is depressed. The second contact is of largely U-shape, with a middle (64) and lower section (52) in a fixed position and with an upper section (60) that can resiliently bend. The second contact is a thicker plate of sheet metal with a top section (28) that forms the top of the cavity front and which has a front edge (30) which engages a contacting part (66) at the front of the first contact upper section. The second contact is mounted to lie on the outside of the housing.

19 Claims, 3 Drawing Sheets

MINIATURE ELECTRICAL SWITCH

CROSS-REFERENCE

This application claims priority from French patent application 98 09851 filed Jul. 31, 1998.

BACKGROUND OF THE INVENTION

There are applications where very small and low cost switches are required, which can be easily mounted on a circuit board, such as to detect full insertion of a card. In order to achieve small size and low cost, there should be a minimum of parts that can be easily formed and assembled. Such a switch would be of value in many applications.

SUMMARY OF THE INVENTION

In accordance with one embodiment of the present invention, a miniature electrical switch is provided for mounting on a circuit board or the like, where the switch is constructed of a minimum number of simple parts. The switch includes a molded dielectric housing and first and second sheet metal contacts. The housing has a bottom wall that lies adjacent to the circuit board and has vertical rear and side walls that form a forwardly-opening cavity. The first contact lies primarily in the cavity and is of largely U-shape, with a lower section that is fixed to the housing and with an upper section that is unrestrained and that can be deflected downward. The second contact includes a top section that lies over the front of the cavity and that has a front edge that is positioned to engage the upper section of the first contact.

The bottom of the housing side walls have grooves opening to the cavity, and opposite sides of the first contact bottom section have sidewardly-projecting edges that slide within the grooves when the first contact is pushed into the cavity. One of the side edges forms a sharp comer to prevent the first contact from pulling out of the groove. The second contact has a mid section that lies behind the rear wall of the housing, with the mid section having a hole that receives a stud projecting from the rear wall of the housing, and with the stud being deformed to lock the second contact in place. The side walls have upper ends with rails that can be heat deformed over the top section of the second contact to lock it in place. The second contact lies outside the housing, and the second contact upper section forms an exposed flat surface for pickup by a vacuum holder.

The first contact top section has a front portion with a contacting section that actually engages the second contact. The contacting section extends at a forward-upward incline, to provide wiping action against the front edge of the second contact top section.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
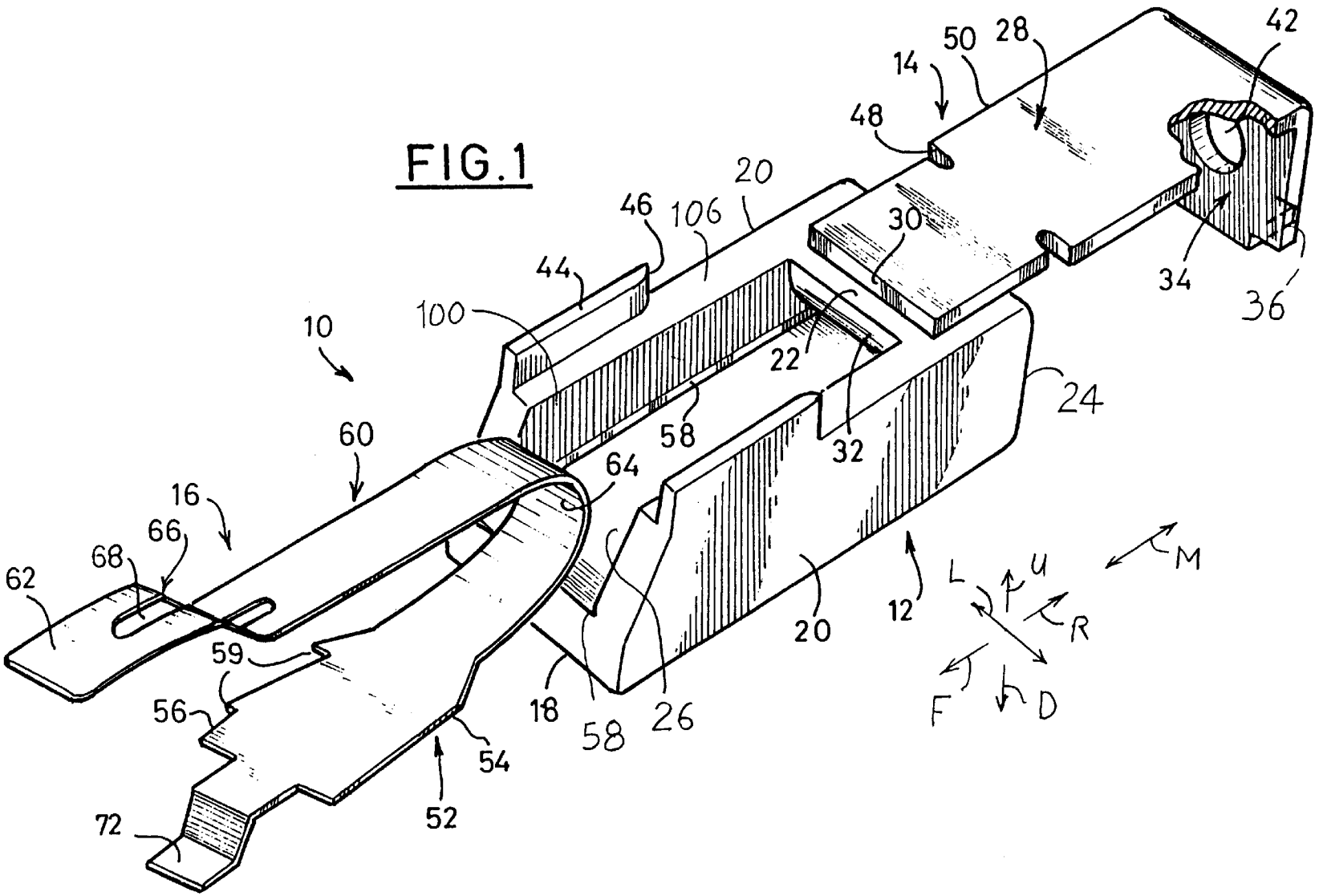
FIG. 1 is an exploded isometric view of a switch constructed in accordance with the present invention.
Figure 3:
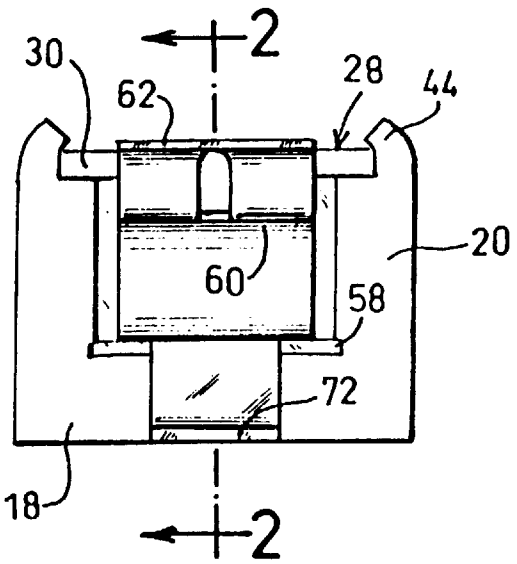
FIG. 3 is a front elevation view of the switch of FIG. 2.

FIG. 1 illustrates an electrical switch 10 which includes a housing 12 and first and second contacts 16, 14. The housing

12 is molded from a plastic material, such as a liquid-crystal polymer, while the two contacts are each formed from sheet metal and are plated. The housing includes a bottom wall 18, a pair of primarily vertical side walls 20 that are laterally L spaced, a rear wall 24, and a short upper wall 22 that braces the side walls. Forward and rearward directions are indicated by arrows F, R, with both of these being longitudinal directions indicated by arrow M. Up and down directions are indicated by arrow U, D. The housing forms a forwardly-opening cavity 26 that receives the first contact 16. The second contact 14 lies over the top of the cavity.

The first contact 16 includes a middle 64 which is bent into a loop of about 180°, about a lateral axis. The first contact includes upper and lower sections 60, 52 which both extend forwardly from the middle. The second contact 14 includes a top section 28 that covers a top opening 100 in the cavity, and which has a front edge that engages the upper section 60 in a rest position of the switch. The second contact has a middle section 34 which extends primarily vertically along the housing rear wall 24, and a terminal 36 which extends horizontally and that can be soldered to a circuit board.

Figure 2:
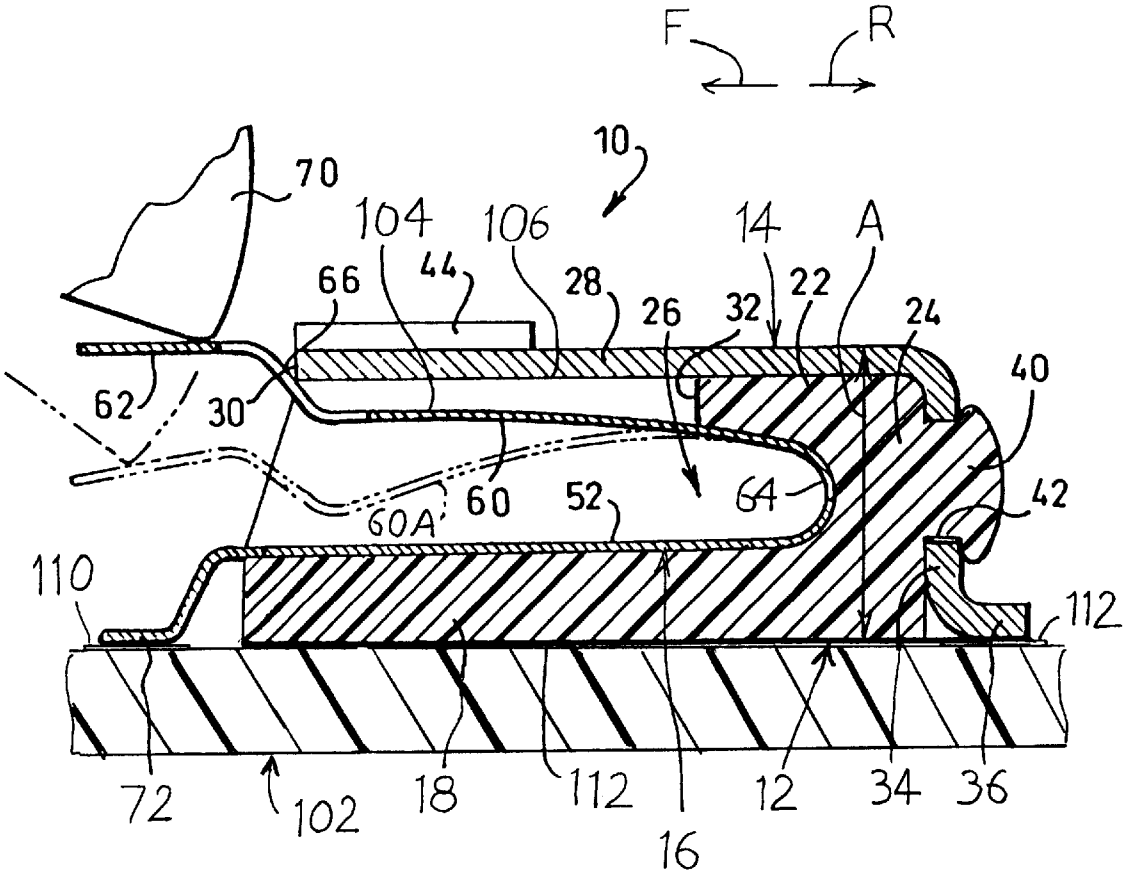
FIG. 2 is a sectional side view of the switch of FIG. 1, shown mounted on a circuit board and showing a portion of an actuating cam, FIG. 2 being taken on line 2—2 of FIG. 3.

FIG. 2 shows the switch 10 fully assembled and mounted on a circuit board 102. The first contact has its lower section 52 and middle 64 fixed in position on the housing 12. However, the upper section 60 is free to deflect downwardly, as to the position 60A. A cam or deflecting member 70 is shown, which can rotate to downwardly deflect the upper section. The upper section has a bendable first part 104 that extends forwardly from the middle 64, a contacting part 66 that extends forwardly and upwardly from the first part 104, and a depressable end 62 that extends forward from the contacting part 66. The contacting part 66 directly engages the front edge 30 of the second contact top section 28 to make contact with it, until the depressable end 62 is depressed to open the switch. Engagement of the contacts actually occurs at the bottom of the front edge 30. The front edge 30 is even with the top of the housing.

FIG. 1 shows that the first contact lower section 52 has laterally opposite side edges 54, 56 which are more widely spaced than the middle 64 or upper section 60. The side edges are designed to fit into a pair of longitudinally M extending grooves formed at the inside of the side walls 20 at the bottom of the cavity. The first contact can be installed by moving it forwardly until the opposite side edges 54, 56 enter the grooves 58 and then forcing the lower section 52 forwardly to the fully installed position of the first contact. One of the edges 56 has teeth 59 which are projections with sharp comers, that dig into the plastic of the housing 12. If the lower section is pulled forwardly after being installed in the housing, the teeth resist forward movement of the first contact.

The contacting part 66 of the first contact extends at an upward-rearward incline. As shown in FIG. 2, this results in a wiping action, in that the upward bias of the upper section 60 tends to cause the contacting part 66 to slide forwardly after it first engages the second contact front edge 30, thereby tending to wipe away any dust or oxidation on the surfaces of the contacts where they touch. The contacting part 66 preferably extends at an angle of more than 20° to the horizontal, and can extend at any angle less than 90°. However, an angle of more than about 70° makes the contacting point along the contacting part 66 hard to control and may result in excessive wear.

FIG. 1 shows that the contacting part has a slot 68 that extends along the length of the contacting part 66 and preferably slightly more. The slot results in two arms along the contacting section 66, with the arms able to flex slightly differently from each other. This results in two contact points, resulting in greater assurance that at least one low resistance contact point will always result when the switch is closed.

FIG. 2 shows that the second contact 14 lies on the outside of the housing, along its top and rear ends. This makes mounting of the second contact relatively easy. The housing 12 has a rearwardly-extending stud 14 extending from its rear wall 24, with the stud initially being cylindrical. The second contact middle section 34 has a hole 42 that receives the stud 40 when the second contact is moved in a forward direction F to the position shown. The stud 40 can be deformed to form a bead as shown, by deforming with heat, as by pressing a hot tool against the stud. Applicant fixes the position of the top section 28, especially at its front edge 30, by providing the housing side walls 20 (FIG. 1) with a pair of upstanding rails 44. When the second contact is installed, it is slid forward until forwardly-facing shoulders 48 abut rear ends 46 of the rails. Then, the rails 44 are heated and folded inwardly towards each other and against the top section 28 of the second contact to press the contact top section 28 firmly against the upper surfaces 106 of the side walls. After the rails are folded over, the stud 40 (FIG. 2) is heat deformed to the configuration shown. This assures that the top section 28 has reached its full forward position against the shoulders 46 and lies flat against the top of the housing.

Figure 4:
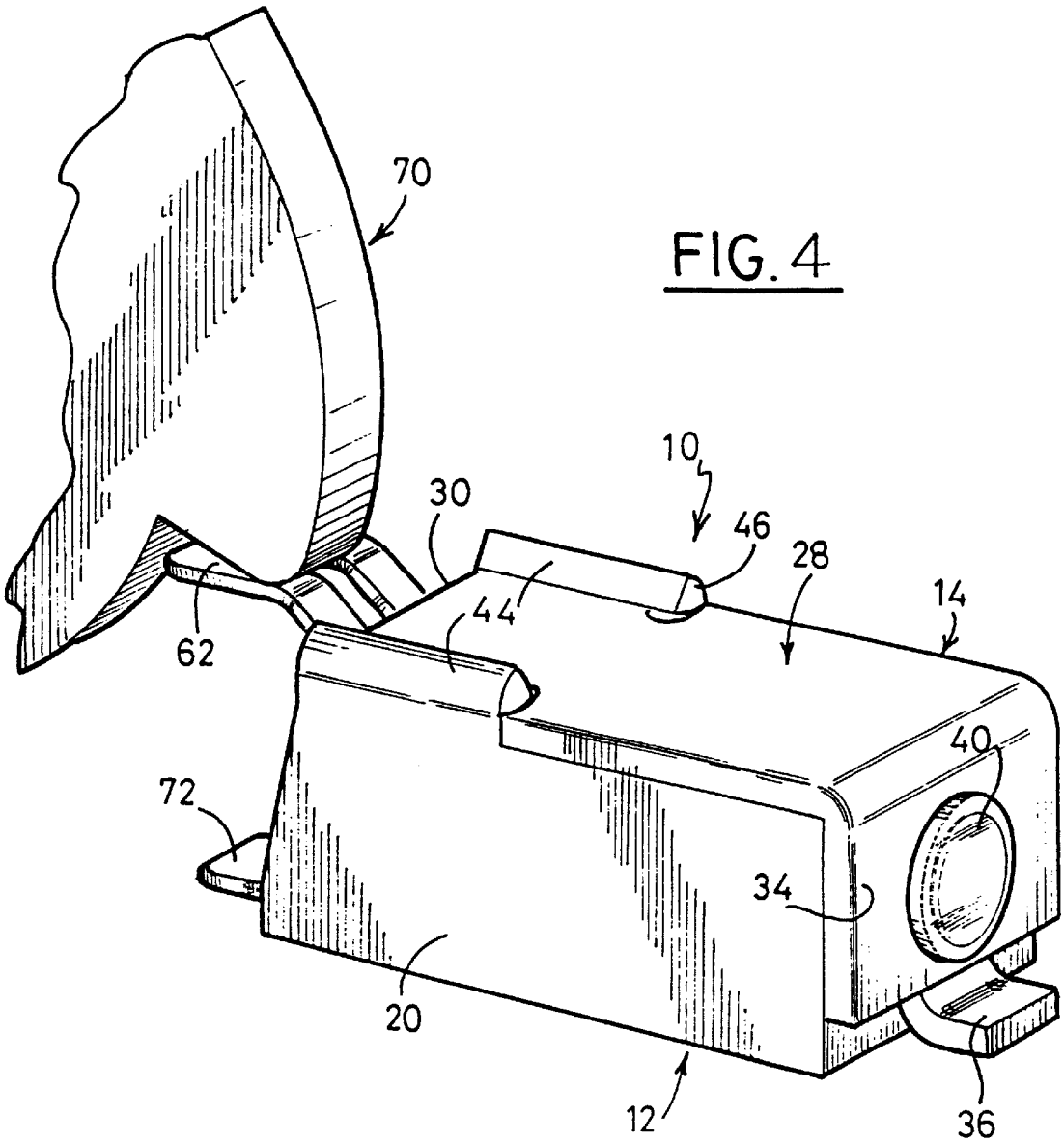
FIG. 4 is a rear and top perspective view of the assembled switch of FIG. 1, and also showing a portion of the actuating cam.

The mounting of the second contact top section 28 (FIG. 4) on the outside of the housing (except at the rails 46 and stud 40), not only makes mounting easy, but aids in handling the miniature switch. The top surface of the top section 28 covers most and almost the entire area (over 75% and preferably over 85%) of the switch as seen in a plan view. Also, the top surface of the top section 28 is flat and resistant to scratches and warping (it is thick). This allows the miniature switch to be picked up and handled by a vacuum nozzle, which facilitates mounting on the circuit board.

FIG. 2 shows that the first contact lower section 52 has a forward end forming a terminal 72 that is downwardly stepped. The bottom of the terminal 72 engages a trace 110 on the circuit board and is soldered thereto. Similarly, the third section or terminal 36 of the second contact engages a trace 112 on the circuit board and is soldered thereto. The terminals 72, 36 preferably lie (when undeflected) very slightly below the bottom surface 112 of the housing, so the bottom of the housing lies adjacent to the circuit board and the terminals 72, 36 can engage the circuit board traces and be soldered thereto.

The second terminal 14 is formed of sheet metal having a greater thickness than the sheet metal of the first contact 16. In one example, the first contact 16 is formed of sheet metal of a thickness of 0.2 mm, while the second contact 14 is formed of sheet metal having a thickness of 0.6 mm. The greater thickness (at least 50% greater) of the second contact is acceptable because no part of it flexes. The greater thickness results in greater rigidity, so soldering of the terminal 36 to the circuit board can more rigidly hold the housing and the rest of the switch rigidly in place on the circuit board.

In a switch that applicant has designed, the height A of the switch was 1.5 mm, the lateral width of the switch was 2 mm, and the longitudinal length of the switch was 5 mm. Even smaller switches are required in some application. The very small size of the switch makes it especially important that there be a minimum number of components, that the components be easily mounted, and that the resulting switch be of rugged construction. The mounting of the second contact top section 28 on the outside of the housing, along its top and rear walls, makes construction of the miniature switch simple and rugged. It also results in a large deflection distance for the first contact upper section 60. A thinner housing bottom wall would allow even greater deflection. In FIG. 2, the contacting part 66 can be depressed by 42% of the total height of the switch (including the rails 44).

While terms such as "upper", "lower", etc. have been used herein to describe the invention as it is illustrated, it should be understood that the switch can be used in any orientation with respect to the earth.

Thus, the invention provides a miniature electrical switch of simple and rugged construction. The switch includes three parts, including a molded plastic housing, and two sheet metal contacts. A first contact has its lower section and middle fixed in a housing cavity and has an upper section that is free to resiliently deflect. The second contact is formed of thicker sheet metal and is placed on the outside of the housing, with its top section covering almost the entire area of the housing as seen in a plan view. A front edge of the second contact is positioned to directly engage the upper section of the first contact, until the upper section is downwardly depressed. The upper section preferably has an inclined contacting section, which may have a slot to provide two contact points. The second contact is fixed to the housing by projecting a stud of the housing through a hole and deforming a stud, and by folding over rails at the top of the side walls to hold down the upper section of the second contact. The second contact is formed of sheet metal having a thickness at least 50% greater than that of the first contact.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A miniature electrical switch for mounting on a circuit board that has a plurality of electrically conductive traces, comprising:

a dielectric housing that has a bottom for lying adjacent to said circuit board;

first and second electrically conductive contacts that are each mounted on said housing;

said first contact having primarily horizontally-extending elongated upper and lower contact sections and a curved middle that joins said contact sections, with said lower section being fixed to said housing and having a terminal positioned to engage one of said traces on said circuit board, and with said upper section being unrestricted against downward deflection along most of the length of said upper section and having a front portion with a contacting part;

said second contact has a terminal positioned to engage one of said traces on said circuit board, a middle section that extends generally upward along said housing, and a top section that lies over said contacting part and that engages said contacting part, with said front portion of said first contact upper section being downwardly depressable to move said contacting part out of engagement with said top section of said second contact.

2. The switch described in claim 1 wherein:

said housing has bottom, rear, and side walls that form a cavity that opens in a forward direction, with said middle of said first contact and parts of said upper and lower sections of said first contact lying in said cavity;

said top section of said second contact lies over the top of said cavity and covers most of the area of said housing when seen in a plan view.

3. The switch described in claim 2 wherein:

said front portion of said first contact has a free end that projects forwardly out of said housing cavity, and said lower section of said first contact has a front end that extends forward and downwardly out of said housing cavity and that forms said terminal portion.

4. The switch described in claim 1 wherein:

said top section of said second contact has a front end with a bottom edge;

said contacting part extends at an upwardforward incline and engages said bottom edge, whereby to obtain a wiping action when said contact part moves down and back up again.

5. The switch described in claim 1 wherein:

said terminal, middle section, and top section of said second contact all lie outside said housing.

6. The switch described in claim 1 wherein:

said lower section of said first contact has opposite side edges;

said housing has a pair of primarily horizontal grooves positioned to receive said side edges of said first contact lower section, with at least one of said side edges having a sideward projection with a tooth that can bite into the material of said housing.

7. The switch described in claim 1 wherein:

said side watts have upper ends forming rails that are heat deformed against an upper face of said second contact top section.

8. The switch described in claim 1 wherein:

said housing has a rear wall with a rearwardly-projecting stud;

said second contact middle section has a hole, with said stud projecting through said hole and having an enlarged stud rear end, to lock said middle section to said housing.

9. The switch described in claim 1 wherein:

said housing has vertical side walls with top surfaces, and said second contact top section lies on said top surface and covers the top of the front of said cavity.

10. The switch described in claim 1 wherein:

said contacting part of said first contact has a slot with said slot having closed front and rear ends, to thereby provide two contact locations.

11. A combination of a circuit board that has a plurality of traces and a miniature electrical switch mounted on the circuit board, comprising:

a dielectric switch housing having a bottom wall lying facewise adjacent to said circuit board, a rear wall, and opposite side walls, with said housing forming a cavity that opens in a forward direction;

a first contact which is of largely U-shape, with top and bottom sections and with a middle bent into a loop and lying in said cavity adjacent to said rear wall, said bottom section extending forwardly from said middle and fixed to said housing, with said bottom section having a front end projecting out of a front end of said cavity and forming a terminal that is soldered to one of said traces on said circuit board, and said top section extends forwardly from said middle and is biased upward but is free to be resiliently downwardly deflected, with said top section having a front end forming a contacting part;

a second contact that has a middle section that extends generally vertically along said rear wall, a terminal section that extends from the bottom of said second contact middle section and that is soldered to one of said circuit board traces, and a top section that extends forwardly along the top of said housing and that has a forward end engaged with said contacting part of said first contact top section.

12. The combination described in claim 11 wherein:

said middle section of said second contact lies on the outside of the rear of said housing rear wall.

13. The combination described in claim 12 wherein:

said middle section of said second contact has a hole;

said housing rear wall has a rearwardly projecting stud that projects through said hole and which is deformed to lock said middle section to said rear wall.

14. The combination described in claim 11 wherein:

said housing is devoid of a top wall along at least a front part of said housing, and said top section of said second contact lies at the top of said housing over said front part.

15. The combination described in claim 11 wherein:

said second contact middle and top sections lie on the outside of said housing and are formed of sheet metal that is at least 50% thicker than the sheet metal of said first contact.

16. The combination described in claim 11 wherein:

said top section of said second contact has a front edge;

said contacting part extends at an upward-forward incline and lies against said front edge, whereby to obtain a wiping kind of action when said contact part moves down and back up again.

17. The combination described in claim 11 wherein:

said lower section of said first contact has opposite side edges;

said housing has a pair of primarily horizontal grooves positioned to receive said side edges of said first contact lower section, with at least one of said side edges having a sideward projection with a sharp edge that can bite into the material of said housing.

18. A method for constructing a miniature switch, comprising:

molding a housing of a dielectric polymer, with a bottom wall, rear wall, and opposite side walls, to form a forwardly-opening cavity;

installing into said cavity, a first contact that has upper and lower sections and a middle section where said middle is bent to extend in about a half circle and said lower section has opposite edges, and pushing said contact rearwardly into said cavity;

installing a second contact that has a primarily vertical section and a primarily horizontal top section, on the outside of said housing, including placing said vertical section against the rear of said housing rear wall and placing said top section above said cavity with said top section depressing a front part of said first contact top section.

19. The method described in claim 18, wherein:

said opposite side walls have lower portions with grooves that have open front ends;

said step of installing said first contact includes pushing said opposite side edges along said grooves.

* * * * *